US009620905B2

(12) United States Patent
Bergner

(10) Patent No.: US 9,620,905 B2
(45) Date of Patent: Apr. 11, 2017

(54) VEHICULAR CABLE ASSEMBLY

(71) Applicant: TE Connectivity Germany GmbH, Bensheim (DE)

(72) Inventor: Bert Bergner, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/837,884

(22) Filed: Aug. 27, 2015

(65) Prior Publication Data

US 2016/0064867 A1 Mar. 3, 2016

(30) Foreign Application Priority Data

Aug. 27, 2014 (EP) ..... 114182488

(51) Int. Cl.

| | |
|---|---|
| ***H01R 24/00*** | (2011.01) |
| ***H01R 13/6581*** | (2011.01) |
| ***H01R 12/53*** | (2011.01) |
| ***H01R 12/75*** | (2011.01) |
| ***H01R 13/6463*** | (2011.01) |
| ***H01R 13/6585*** | (2011.01) |
| ***H01R 24/56*** | (2011.01) |
| ***H01R 12/70*** | (2011.01) |

(52) U.S. Cl.

CPC ..... *H01R 13/6581* (2013.01); *H01R 12/53* (2013.01); *H01R 12/7076* (2013.01); *H01R 12/75* (2013.01); *H01R 13/6463* (2013.01); *H01R 13/6585* (2013.01); *H01R 24/568* (2013.01); *H01R 2201/26* (2013.01)

(58) Field of Classification Search

CPC H01R 12/53; H01R 13/6581; H01R 12/7076; H01R 12/75; H01R 24/568; H01R 2201/26; H01R 13/6585; H01R 13/6463

USPC ..... 439/607.35

See application file for complete search history.

(56) References Cited

U.S. PATENT DOCUMENTS 4,556,275 A * 12/1985 Hamsher, Jr. ..... H01R 23/6873 29/858

5,387,124 A * 2/1995 Shinohara ..... H01R 23/66 439/445

(Continued)

FOREIGN PATENT DOCUMENTS

WO 2011129264 A1 10/2011

WO 2012050628 A1 4/2012

OTHER PUBLICATIONS

European Search Report, App. No. 14182488.8-1801, dated Feb. 10, 2015, 6 pages.

*Primary Examiner* — Abdullah Riyami

*Assistant Examiner* — Nelson R Burgos-Guntin

(74) *Attorney, Agent, or Firm* — Barley Snyder

(57) ABSTRACT

A vehicular cable assembly that is easy to install and allows high transmission rates. This vehicular cable assembly includes at least two unshielded conductive signal lines that are untwisted around each other in a connection region in which the unshielded conductive signal lines are adapted to be connected to an external element and twisted around each other in a region next to the connection region. This vehicular cable assembly also includes a shielding assembly having at least one canal-like receptacle shielding part extending at least along the entire connection region and within which the unshielded conductive signal lines are disposed.

18 Claims, 9 Drawing Sheets

(56) References Cited

U.S. PATENT DOCUMENTS

| | | | | |
|---|---|---|---|---|
| 5,993,268 | A * | 11/1999 | Yamaguchi | H01R 13/432<br>439/746 |
| 8,449,330 | B1 * | 5/2013 | Schroll | H01R 13/514<br>439/607.06 |
| 9,331,446 | B2 * | 5/2016 | Bluemmel | H01R 43/048 |
| 2004/0115997 | A1 * | 6/2004 | Scherer | H01R 13/514<br>439/752 |
| 2010/0009571 | A1 * | 1/2010 | Scherer | H01R 13/518<br>439/607.05 |
| 2016/0064867 | A1 * | 3/2016 | Bergner | H01R 12/53<br>439/607.35 |

* cited by examiner

VEHICULAR CABLE ASSEMBLY

CROSS-REFERENCE TO RELATED APPLICATIONS

This application claims the benefit of the filing date under 35 U.S.C. §119(a)-(d) of European Patent Application No. 14182488.8 filed Aug. 27, 2014.

FIELD OF THE INVENTION

The present invention relates, in general, to a vehicular cable assembly and, in particular, to a vehicular cable assembly for data transmission within a vehicle.

BACKGROUND

In order to save space and manufacturing costs, the signal lines of vehicular cable assemblies are often unshielded. However, the transmission rate of such cable assemblies is limited. On the other hand, cable assemblies that are adapted for higher transmission rates are usually shielded and thus rigid and bulky, which in addition to the higher costs also makes it more difficult to install them.

SUMMARY

The object of the invention is thus to provide a vehicular cable assembly that is easy to install and allows high transmission rates.

Accordingly, a vehicular cable assembly, constructed in accordance with the present invention, includes at least two unshielded conductive signal lines that are untwisted around each other in a connection region in which the unshielded conductive signal lines are adapted to be connected to an external element and twisted around each other in a region next to the connection region. A vehicular cable assembly, constructed in accordance with the present invention, also includes a shielding assembly having: at least one canal-like receptacle shielding part extending at least along the entire connection region and within which the conductive signal lines are disposed.

Due to the use of unshielded conductive signal lines, the cable assembly is very compact. The twisting of the signal lines in the region next to the connection region allows high transmission rates above 100 Mbps.

The invention will be described below on the basis of advantageous developments and with reference to the figures. The features of the embodiments and the advantageous developments are independent from each other and can be combined as desired.

DETAILED DESCRIPTION OF THE EMBODIMENT(S)

Figure 1:
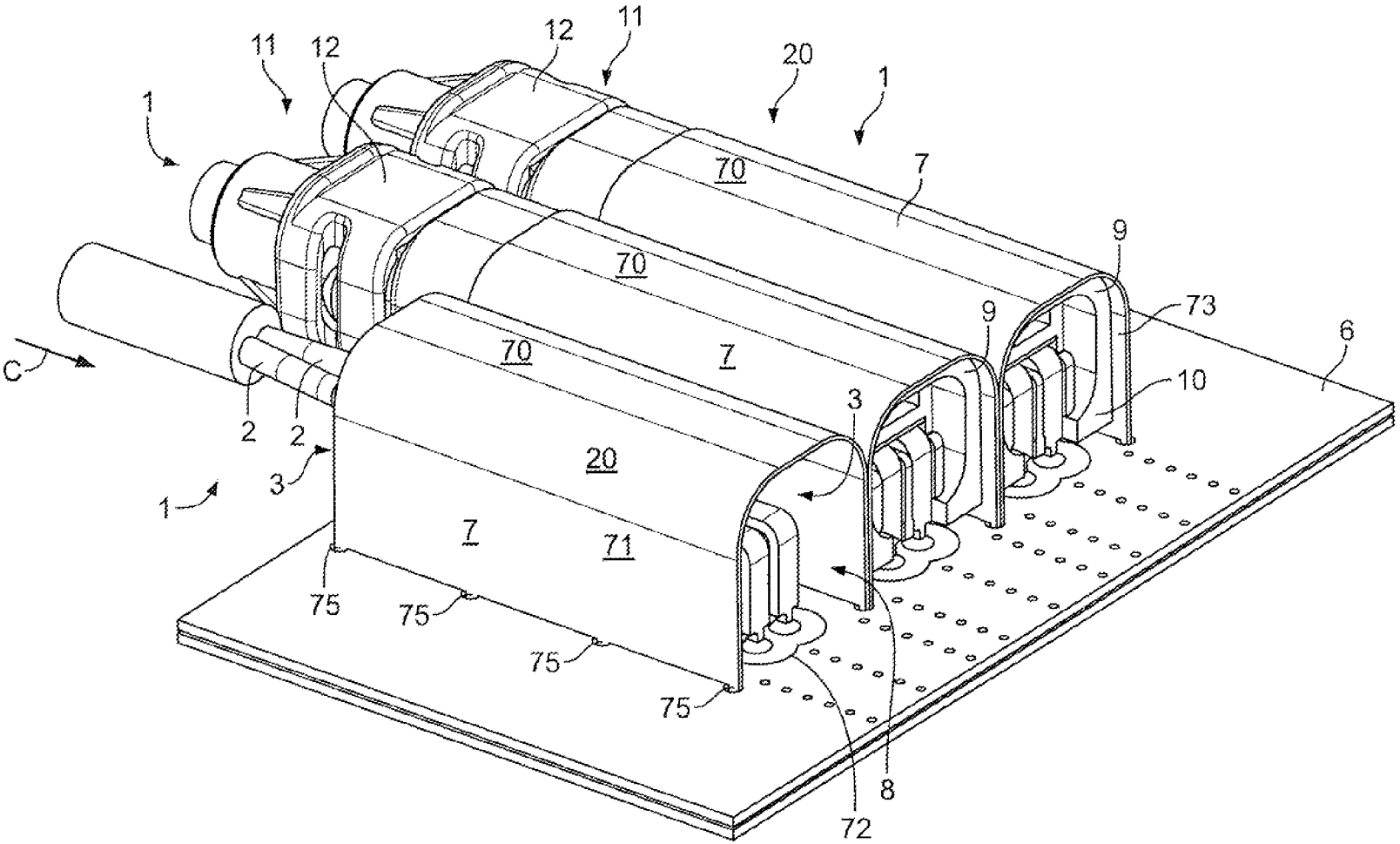
FIG. 1 shows a schematic perspective view of a first advantageous embodiment of the present invention with some parts removed.
Figure 2:
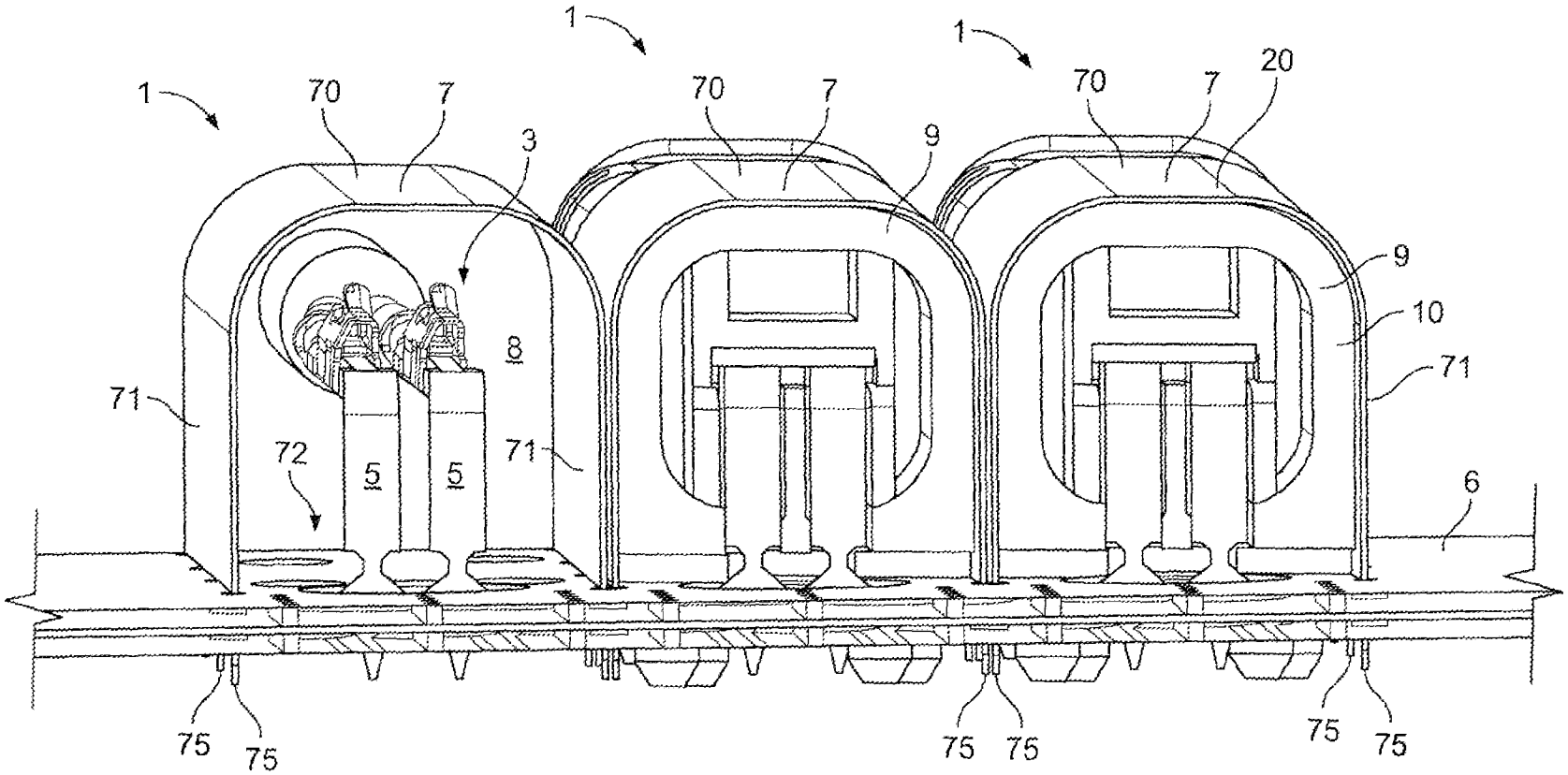
FIG. 2 shows a schematic perspective view of the embodiment of FIG. 1 from a different angle.

In FIGS. 1 and 2, a first embodiment of a cable assembly 1 according to the invention is shown. Some parts are removed so that the internal structure can be seen.

Figure 3:
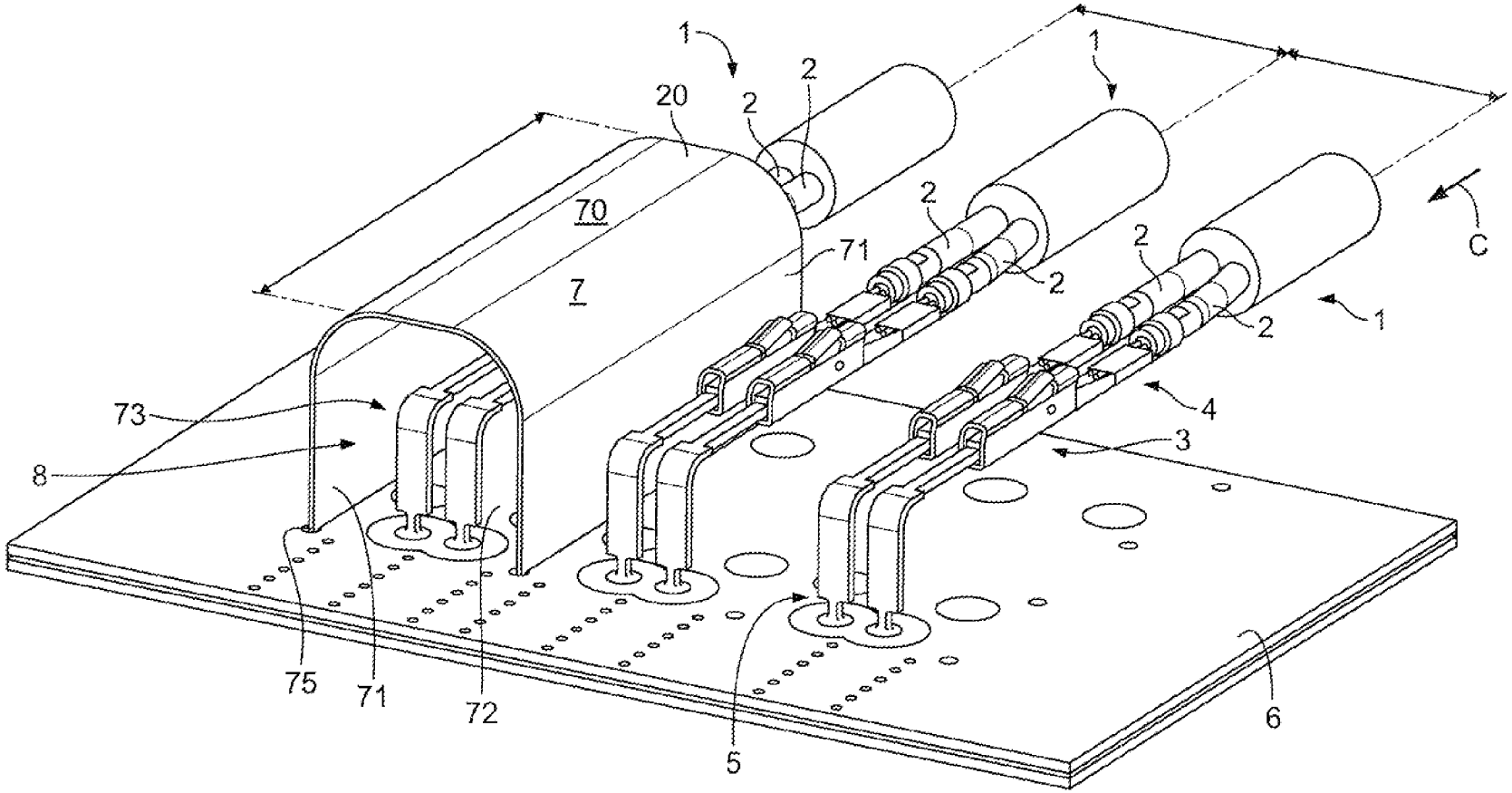
FIG. 3 shows a schematic perspective view of the embodiment of FIGS. 1 and 2 with more parts removed.

The cable assembly 1 can be used for data transmission in vehicles like cars or trucks. It is, in particular, suited for data rates above 100 Mbps. The cable assembly 1 comprises two unshielded conductive signal lines 2, preferably extending in parallel to each other. In a connection region 3, the signal lines 2 are adapted to be connected to external elements, in this case to terminals 5 of a PCB (Printed Circuit Board) 6 that are embodied as pins received in the PCB 6 and bent 90° to enable contact with the terminals 4 of the cable assembly 1 that lie parallel to the plane of the PCB 6 as shown in FIG. 3.

In the connection region 3, the signal lines 2 are not twisted around each other to allow a contacting. Next to the connection region 3, the signal lines 2 are twisted around each other. The two signal lines 2 form a twisted pair in order to improve electromagnetic compatibility next to the connection region 3. The two signal lines are twisted around each other in a double helical fashion. No further shielding is provided here.

A shielding assembly 20, which comprises a shielding part 7, has a canal-like receptacle 8. The canal-like receptacle 8 extends along the entire connection region 3 and is adapted to receive the signal lines 2. The shielding part 7 and thus the shielding assembly 20 provides sufficient shielding efficiency in the connection region 3 and has, at the same time, a shape that allows an easy production and mounting of the shielding part 7 and the shielding assembly 20. The shielding part 7 as shown in FIGS. 1 to 3 has a U-shaped cross-section. In other embodiments, the shielding part 7 can also have a V- or C-shaped cross-section. The shielding part 7, with the U-shaped cross-section as shown in FIGS. 1 to 3, has a common base 70 that joins two legs (or side sections) 71 that are located on longitudinal sides of the cable assembly 1. The common base 70 and the legs 71 thus extend along a cable direction C. The shielding can further have an open longitudinal side 72. Through this open longitudinal side 72 the signal lines 2 can be connected to the PCB 6. In the example of FIGS. 1 to 3, the open longitudinal side 72 faces the surface of the PCB 6. The PCB 6 can comprise a conductive layer, in particular a grounding layer, so that the shielding part 7 together with the PCB 6 shield the connection region 3 360° around the cable direction C.

The legs 71 comprise at their ends remote from the common base 70 fixation members 75. The fixation members 75 serve to fix the shielding part 7 to the PCB 6. Further, they make an electrical contact with a conductive layer of the PCB 6. The fixation members 75 are integral with the rest of the shielding part 7 and can be produced, for example, by cutting and stamping a metal sheet. The fixation members 75 are designed as press-fit elements that can be pressed into the PCB 6. They can also be designed as solderable elements that can, for example, be soldered to the PCB 6. The entire shielding part 7 is made from metal sheet by cutting, bending and stamping. In an alternative embodiment, the shielding part 7 could also be made from a conductive plastic, for example a hybrid material comprising plastic and a metal network. In another embodiment, the shielding part 7 can be configured as a plastic part that is coated with metal.

The terminals 5 of the PCB 6 are held by a retaining element 9 made from plastic. The terminals 5 and the retaining element 9 thus form an unshielded connector. A counter plug 10 that is surrounded by the shielding part 7 can be connected to a plug 11 comprising the signal lines 2 and a further retaining element 12. The plug 11 is also partially surrounded by the shielding part 7. The cable assembly 1 thus comprises the plug 11, the counter plug 10, the shielding part 7 and the PCB 6. The shielding part 7 can be removeable, so that a connection between the plug 11 and the counter plug 10 can be established before the shielding part 7 is attached. The connector 11 and the counter plug 10 are thus inserted into the canal-like receptacle 8 of the shielding assembly 20. In another embodiment, the shielding 7 can be attached to the counter plug 10 and the PCB 6 prior to when the plug 11 is connected to the counter plug 10. The shielding assembly 20 can be pre-mounted to the counter plug 10 or even be integral with the plug 10, for example, if the shielding assembly 20 is moulded into or onto the plug 10 or vice versa. Such a connector can include holding or fixing means for holding or fixing the signal lines, for example, by clamping.

Figure 4:
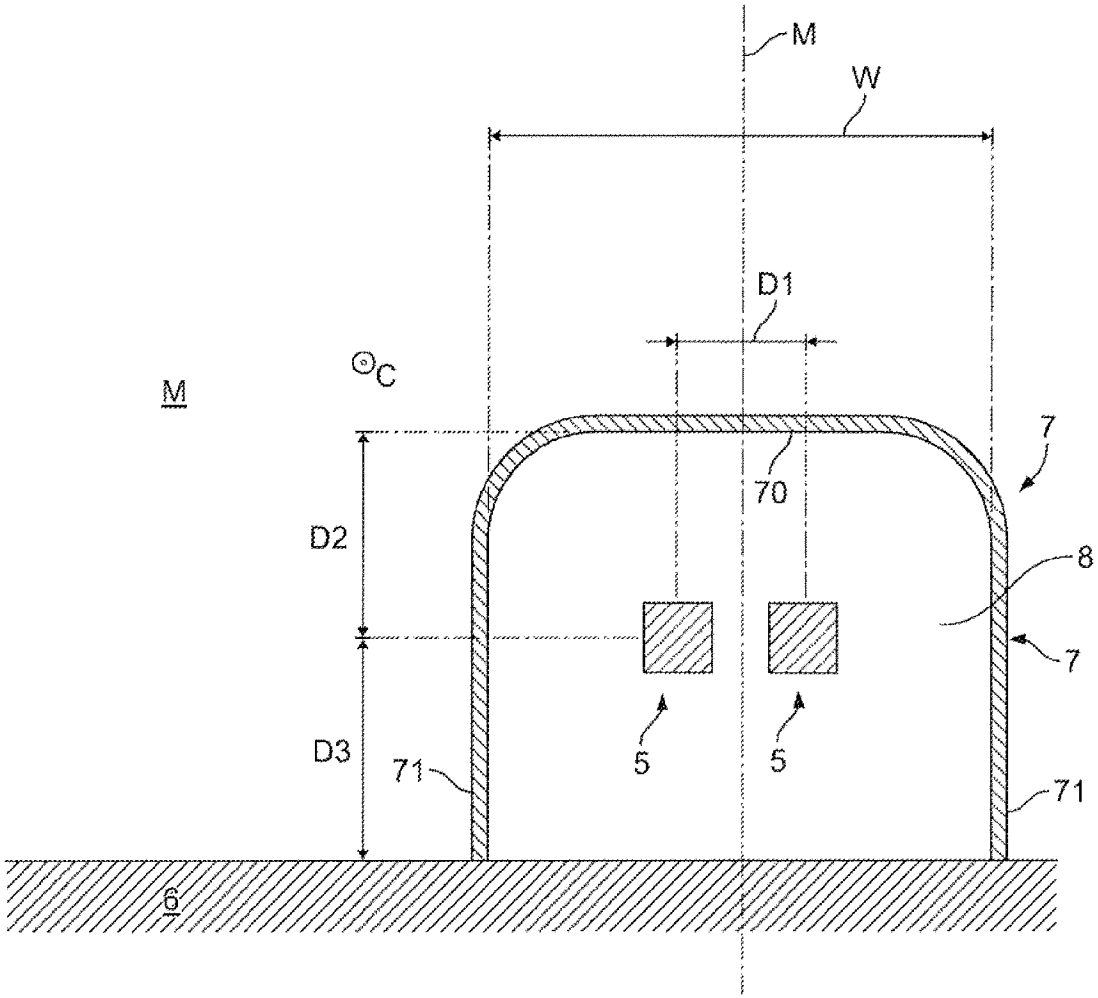
FIG. 4 shows a schematic cross-section through one of the cable assemblies of FIGS. 1 to 3.

In FIG. 4 a schematic cross-section is shown. The shielding part 7 has two mirror symmetries relative to two mirror planes M running essentially through the shielding part 7. A first mirror plane M is parallel to the cable direction C and perpendicular to the plane of the drawing. It runs in an axial direction of the terminals 5 and, at the same time, in a radial direction away from the terminals 5. The terminals 5 are also symmetric about this mirror plane M. A second mirror plane M, relative to which the shielding assembly 20 is symmetric, is parallel to the plane of the drawing. This mirror plane M is thus perpendicular to the cable direction C and an axial direction of the terminal 5. This mirror plane M also runs in a radial direction away from the terminals 5.

The sections of the terminals 5 shown in FIG. 4 and the signal lines 2 are approximately in the center of the shielding part 7. The distance to the common base 70, to the legs 71, and to the PCB 6 is approximately the same. This guarantees a good shielding effect. In the example shown in FIG. 4, the width W of the shielding part 7 is approximately 7.6 mm. The distance D1 between the centers of the two sections of the terminals 5 is approximately 1.8 mm; the distance D2 between the centers of the sections of the terminals 5 and the common base 70 is approximately 3.65 mm; and the distance D3 between the centers of the sections of the terminals 5 and the PCB 6 is approximately 4.25 mm. These values result in a good shielding efficiency.

Figure 5:
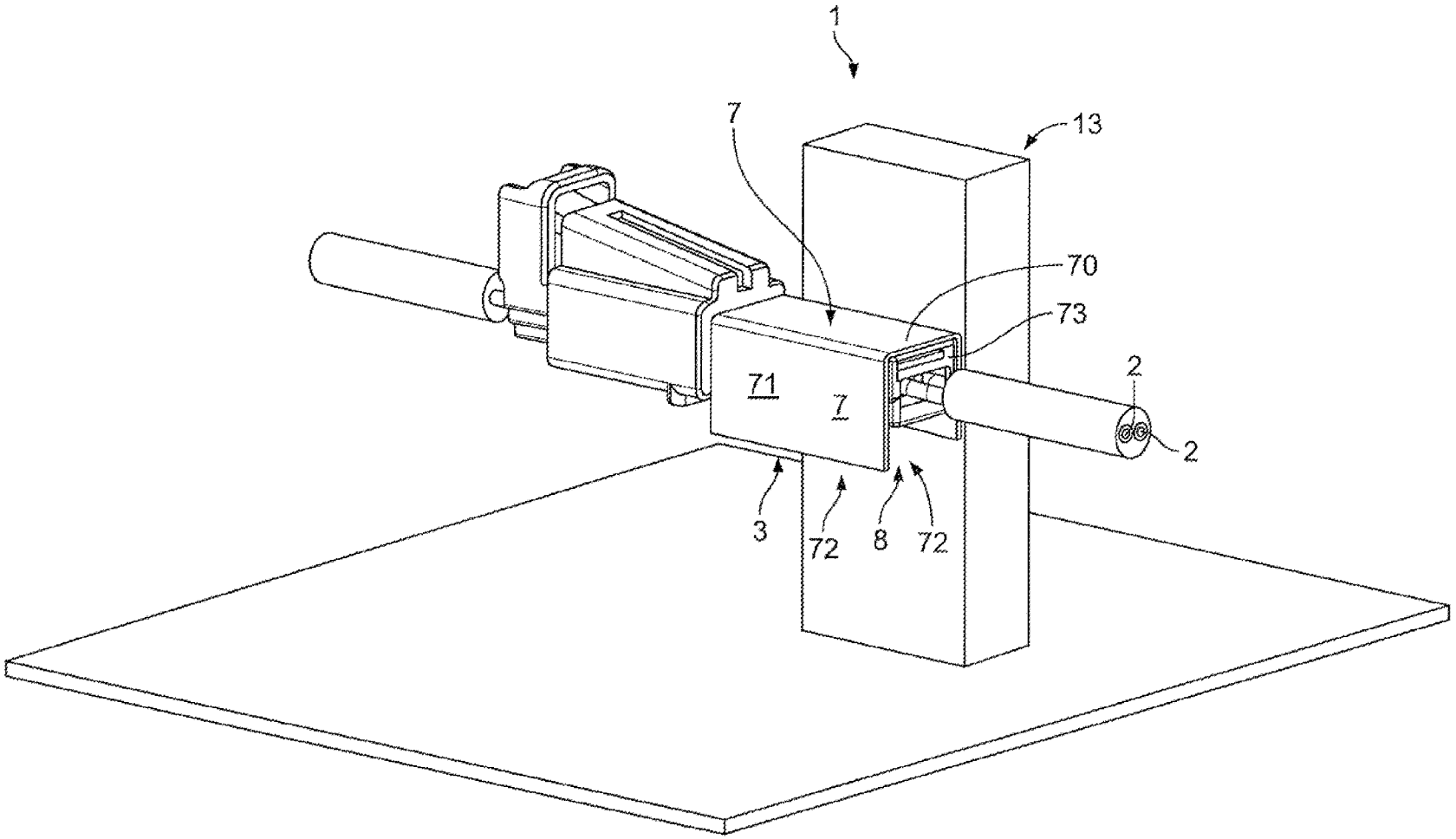
FIG. 5 shows a schematic perspective view of a second embodiment of the present invention.
Figure 6:
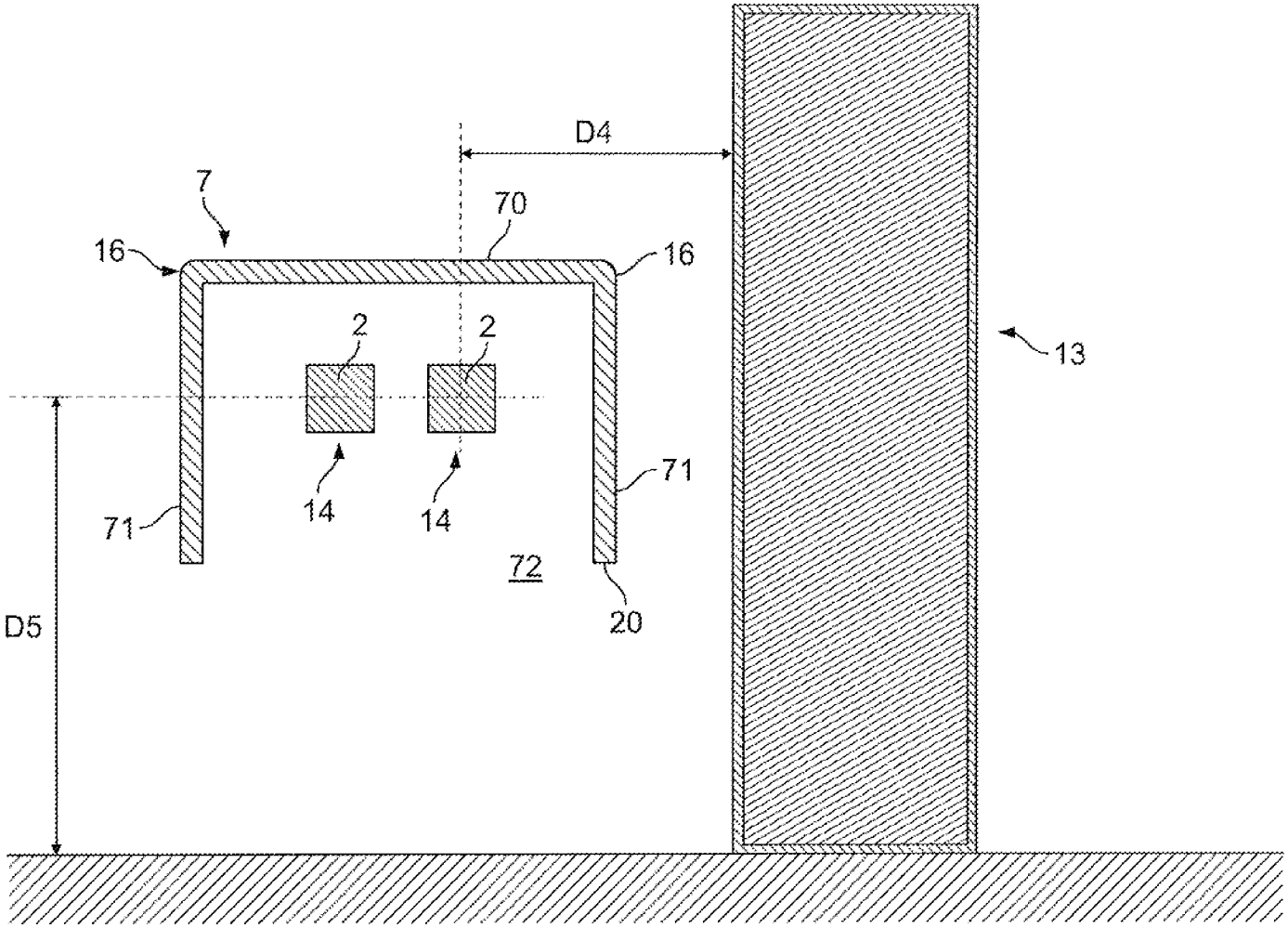
FIG. 6 shows a schematic cross-section through the second embodiment of FIG. 5.

In FIGS. 5 and 6 a second embodiment of a cable assembly 1 is depicted. The cable assembly 1 again comprises a shielding part 7. In this example, the shielding part 7 helps to minimize the influence of a metal block 13 located next to the connection region 3. Although the shielding part 7 is not connected to ground and although the shielding part 7 again has an open longitudinal side 72 shown facing downwards in FIG. 5, the shielding part 7 has a good shielding efficiency, as the open longitudinal side 72 does not face towards the metal block 13.

The shielding part 7 of FIGS. 5 and 6 is more rectangular than the one shown in FIGS. 1 to 4. The transition areas 16 between the legs 71 and the common base 72 are rather sharp and less round than in FIGS. 1 to 4. Such an embodiment might be easier to produce, for example by folding a metal sheet. In the example shown in FIGS. 5 and 6, a good shielding efficiency is achieved. The distance D4 between the center of the right-hand terminal 14 and the metal block 13 is, in this example, 4 mm and the distance D5 between the center of the terminals 14 and the base plate 15 is 20 mm.

Like in the example of FIGS. 1 to 4, the terminals 14 and the signal lines 2 run parallel to each other and are located centrally in the shielding part 7.

Figure 7:
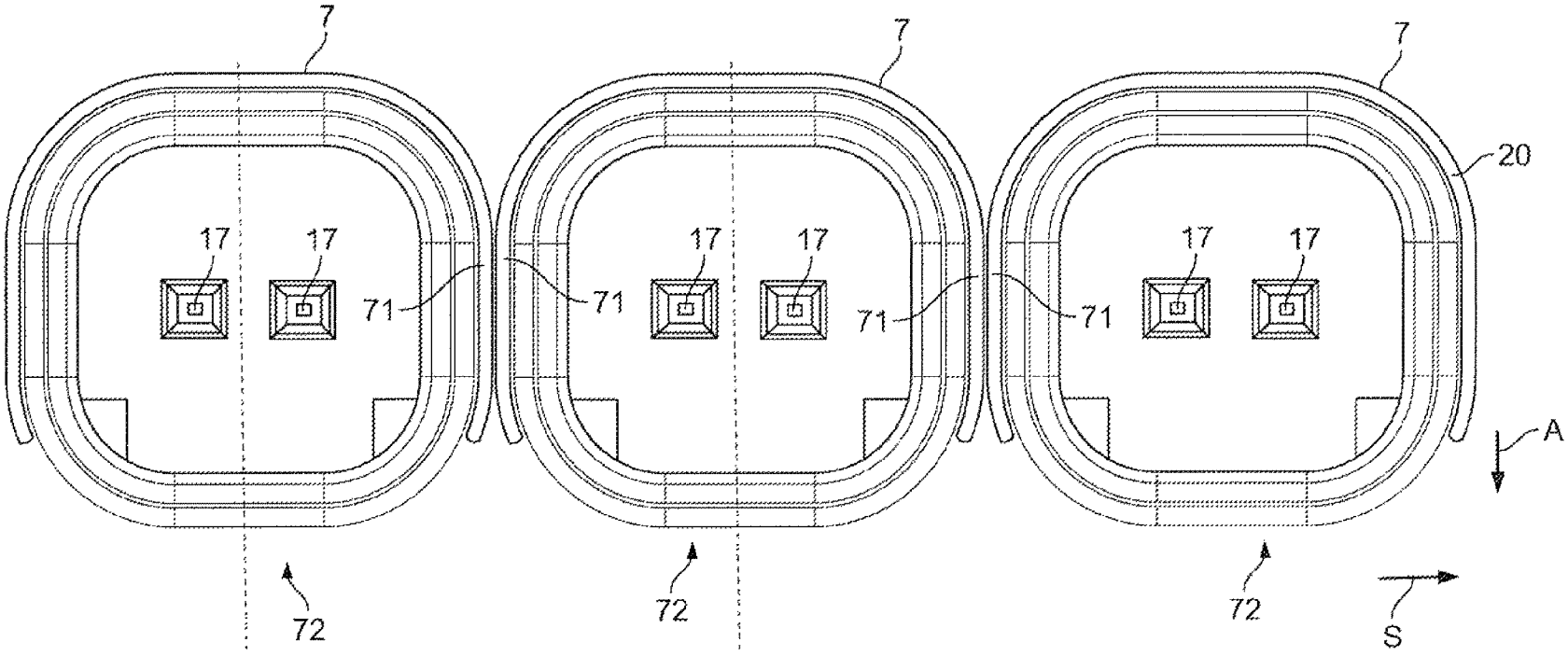
FIG. 7 shows a schematic front view of the arrangement of three cable assemblies according to a third embodiment of the present invention.
Figure 8:
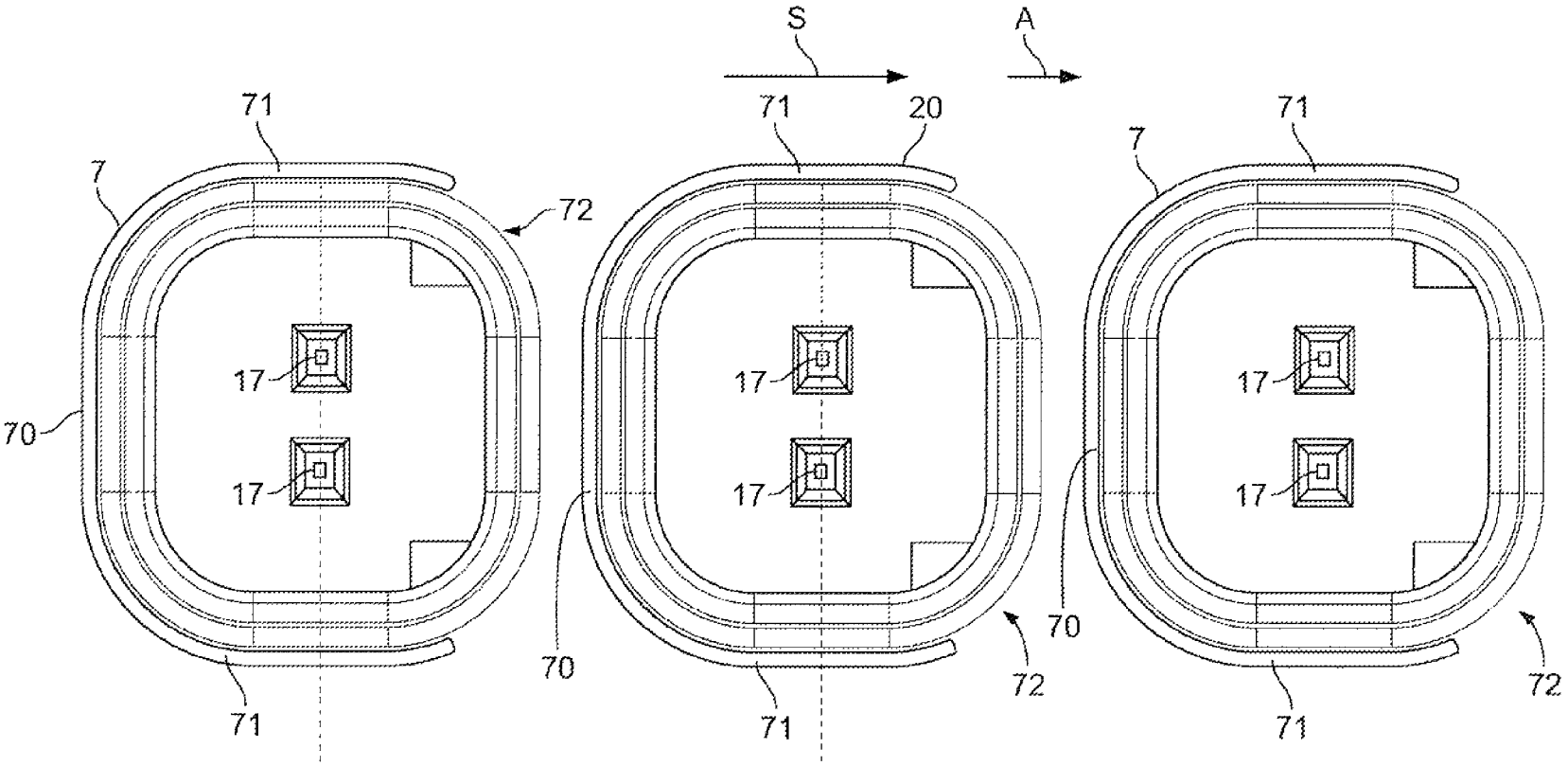
FIG. 8 shows a schematic front view of different arrangements of the cable assemblies of FIG. 7.

In FIGS. 7 and 8, the different relative arrangements of the signal lines 2 and the shielding 7 are depicted.

The configuration of FIG. 7 is, for example, suited for a 90° contacting as shown in FIGS. 1 to 3, as the open longitudinal sides 72 allow to make contact to a planar element like a PCB. All the sections of the terminals 17 shown in FIG. 7 lie in one plane. The shielding parts 7 lie next to each other. The right-hand side leg of the left shielding part 7 is in direct proximity to the left-hand leg 71 of the shielding part 7 in the middle. The right-hand side leg 71 of the shielding part 7 in the middle is, in turn, in direct proximity to the left-hand leg 71 of the shielding part 7 at the right.

In FIG. 8, the shielding parts 7 are rather arranged on top of each other. The open longitudinal side 72 of the left-hand shielding part 7 on the left is in the vicinity of the common base 70 of the shielding part 7 in the middle. In turn, the open longitudinal side 72 of the shielding part 7 in the middle is in the vicinity of the common base 70 of the shielding part 7 on the right. The shielding parts 7 are open in an opening direction A. This opening direction A is parallel to a stacking direction S in which the shielding parts 7 (and the plugs) are stacked behind each other. In contrast, in FIG. 7, the opening direction A and the stacking direction S are perpendicular to each other. The advantage of the arrangement of FIG. 8 is that a better shielding efficiency is achieved.

Figure 9:
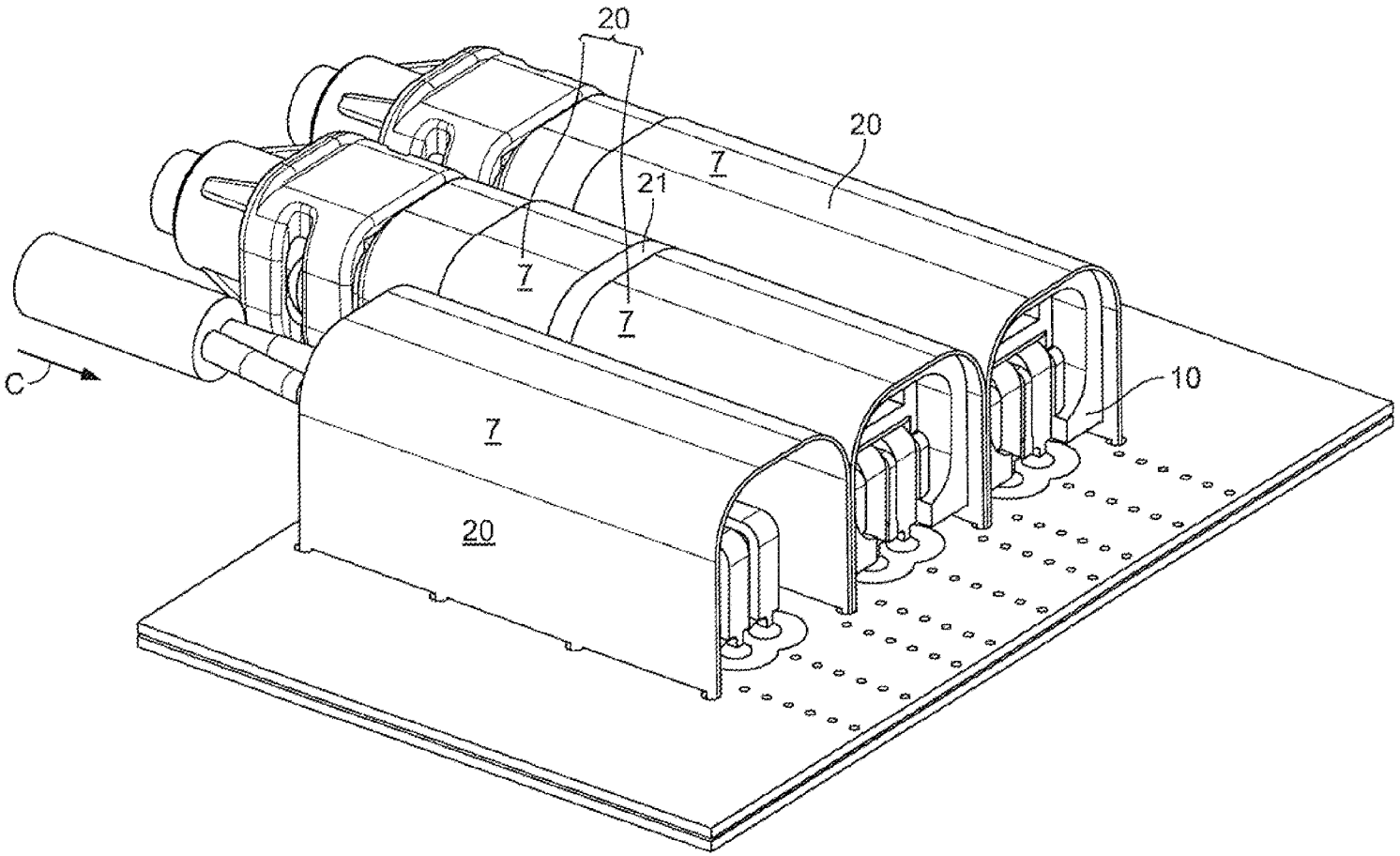
FIG. 9 shows a schematic perspective view of a further advantageous embodiment of the present invention with some parts removed.

As shown in FIG. 9, the shielding assembly can comprise two or more shielding parts 7. The resulting shielding assembly should still extend along the entire connection region to achieve good shielding performance. The two or more shielding parts can abut each other in the mounted state, so that no gaps exist between them or the shielding parts 7 can be separated by a gap 21. The maximum allowable size of these gaps, in the cable direction C, depends on the transmission rate of the cable assembly and on the frequency of the waves that are being transmitted. The size of the gap is preferably less than half of the wavelength that should be shielded, more preferably less than 10% of the wavelength. The shielding parts themselves can also have small holes in them. For the size of the holes the same preferences as for the gaps apply.

What is claimed is:

1. A vehicular cable assembly comprising:

at least one cable, each cable having at least two unshielded conductive signal lines:

(a) untwisted around each other in a connection region in which the unshielded conductive signal lines are adapted to be connected to an external element, and (b) twisted around each other in a region next to the connection region; and a shielding assembly having at least one canal-like receptacle shielding part extending at least along the entire connection region, each canal-like receptacle shielding part corresponding to one cable such that the unshielded conductive signal lines of one cable are disposed within one canal-like receptacle shielding part.

2. A vehicular cable assembly according to claim 1, wherein the canal-like receptacle shielding part comprises two legs joined by a common base.

3. A vehicular cable assembly according to claim 2, wherein the canal-like receptacle shielding part has a U-shaped cross-section.

4. A vehicular cable assembly according to claim 1, wherein the canal-like receptacle shielding part has a V-shaped cross-section.

5. A vehicular cable assembly according to claim 1, wherein the canal-like receptacle shielding part has a C-shaped cross-section.

6. A vehicular cable assembly according claim 2, further including unshielded connectors in the connection region within the canal-like receptacle shielding part and connected to the unshielded conductive signal lines.

7. A vehicular cable assembly according claim 6, wherein the unshielded conductive signal lines have ends adapted for connection to an external element.

8. A vehicular cable assembly according claim, 7 wherein the ends of the unshielded conductive signal lines are pins adapting the ends of the unshielded conductive signal lines for attachment to a printed circuit board.

9. A vehicular cable assembly according claim 1, wherein the unshielded conductive signal lines are disposed symmetrically within the shielding assembly.

10. A vehicular cable assembly according claim 9, wherein the symmetrical disposition of the unshielded conductive signal lines is about a plane perpendicular to the direction of the vehicular cable assembly.

11. A vehicular cable assembly according claim 9, wherein the symmetrical disposition of the unshielded conductive signal lines is about a plane parallel to the direction of the vehicular cable assembly.

12. A vehicular cable assembly according claim 9, wherein the symmetrical disposition of the unshielded conductive signal lines is about a plane perpendicular to the direction of the vehicular cable assembly and parallel to the direction of the vehicular cable assembly.

13. A vehicular cable assembly according to claim 2, wherein the legs of the canal-like receptacle shielding part have fixation members for fixing the canal-like receptacle shielding part to another element.

14. The vehicular cable assembly according to claim 13, wherein the fixation members extend from the legs.

15. The vehicular cable assembly according to claim 13, wherein the fixation members fix the canal-like receptacle shielding part to a printed circuit board.

16. The vehicular cable assembly according to claim 15, wherein the fixation members electrically contact a conductive layer of the printed circuit board.

17. The vehicular cable assembly according to claim 1, wherein the shielding assembly has a plurality of canal-like receptacle shielding parts.

18. The vehicular cable assembly according to claim 17, wherein sides of the plurality of canal-like receptacle shielding parts abut one another.

* * * * *